US005513406A

United States Patent [19]

Foster et al.

[11] Patent Number: 5,513,406

[45] Date of Patent: May 7, 1996

[54] MODULAR HOSPITAL BED AND METHOD OF PATIENT HANDLING

[75] Inventors: L. Dale Foster; Ryan A. Reeder, both of Brookville; John W. Ruehl, Shelbyville; John D. Vogel, Columbus, all of Ind.

[73] Assignee: Hill-Rom Company, Inc., Batesville, Ind.

[21] Appl. No.: 230,061

[22] Filed: Apr. 21, 1994

[51] Int. Cl.[6] ..... A61G 7/00

[52] U.S. Cl. ..... 5/600; 5/620; 5/604; 5/861; 5/503.1

[58] Field of Search ..... 5/600, 613, 616, 5/620, 81.1, 86.1, 658, 503.1, 604, 510

[56] References Cited

U.S. PATENT DOCUMENTS

| | | | |
|---|---|---|---|
| D. 260,816 | 9/1981 | Zissimopoulos . | |
| 1,290,809 | 1/1919 | Truax . | |
| 1,398,203 | 11/1921 | Schmidt . | |
| 1,992,262 | 2/1935 | Upp . | |
| 2,039,901 | 5/1936 | Hawley . | |
| 2,308,592 | 1/1943 | Drexler et al. . | |
| 2,470,524 | 5/1949 | Scudder . | |
| 2,607,929 | 8/1952 | Balluff . | |
| 2,673,771 | 3/1954 | Krewson . | |
| 2,696,963 | 12/1954 | Shepherd . | |
| 2,847,006 | 8/1958 | Griffith . | |
| 2,978,053 | 4/1961 | Schmidt . | |
| 3,032,059 | 5/1962 | McLeod . | |
| 3,038,174 | 6/1962 | Brown et al. . | |
| 3,210,779 | 10/1965 | Herbold . | |
| 3,281,103 | 10/1966 | Kisling . | |
| 3,281,141 | 10/1966 | Smiley et al. . | |
| 3,362,704 | 1/1968 | Pilz | 5/616 X |
| 3,524,512 | 8/1970 | Voeks et al. . | |
| 3,593,350 | 7/1971 | Knight et al. . | |
| 3,596,725 | 8/1971 | Homs . | |
| 3,757,355 | 9/1973 | Allen et al. | 5/604 |
| 3,795,284 | 3/1974 | Mracek et al. . | |
| 3,876,018 | 4/1975 | Mracek et al. . | |
| 3,876,024 | 4/1975 | Shieman et al. . | |
| 3,948,344 | 4/1976 | Johnson et al. . | |
| 4,006,789 | 2/1977 | Stultz et al. . | |
| 4,033,420 | 7/1977 | De Masters . | |
| 4,139,917 | 2/1979 | Fenwick . | |
| 4,155,421 | 5/1979 | Johnson et al. . | |
| 4,225,104 | 9/1980 | Larson . | |
| 4,225,989 | 10/1980 | Corbett et al. . | |

(List continued on next page.)

FOREIGN PATENT DOCUMENTS

| | | |
|---|---|---|
| 2285113 | 9/1974 | France . |
| 2818189 | 6/1979 | Germany . |
| 2812037 | 9/1979 | Germany . |
| 3915882 | 11/1990 | Germany . |
| 2153771 | 8/1985 | United Kingdom . |

*Primary Examiner*—Michael F. Trettel
*Attorney, Agent, or Firm*—Barnes & Thornburg

[57] ABSTRACT

A modular hospital bed and method of patient handling which permits a patient to remain on a single hospital bed from admittance to and through discharge from a hospital, thereby reducing the number of patient bed surface-to-surface transfers and the number of hospital beds. The method comprises providing a plurality of rollable modular beds, assigning a patient to one of the modular beds upon admittance to a hospital emergency room, providing a plurality of retrofittable modules for selective removable securement to the modular beds, with at least one module being provided from each of a patient transport module group, critical care module group and ambulatory/rehabilitation module group, and transforming the one modular bed as the patient is treated in and transferred from the emergency room and transferred to, treated in, and transferred from the surgery room, the critical care unit and the med/surg unit, and finally discharged, by securing to and removing from the one bed selected ones of the retrofittable modules thereby tailoring the one bed to the needs of the patient at any point from admittance to through discharge from the hospital.

10 Claims, 5 Drawing Sheets

U.S. PATENT DOCUMENTS 4,227,269 10/1980 Johnston .
4,262,872 4/1981 Kodet .
4,272,856 6/1981 Wegener et al. .
4,281,730 8/1981 Swersey et al. .
4,298,083 11/1981 Johnson et al. .
4,352,991 10/1982 Kaufman .
4,399,885 8/1983 Johnson et al. .
4,417,638 11/1983 Harvey .
4,417,639 11/1983 Wegener .
4,420,052 12/1983 Hale .
4,435,864 3/1984 Callaway .
4,482,783 11/1984 Laimins .
4,487,276 12/1984 Swersey et al. .
4,511,158 4/1985 Varga et al. .
4,517,690 5/1985 Wegener .
4,528,704 7/1985 Wegener et al. .
4,567,957 2/1986 Johnson .
4,578,833 4/1986 Vrzalik .
4,584,989 4/1986 Stith .
4,592,104 6/1986 Foster et al. ..... 5/616
4,600,209 7/1986 Kerr .
4,627,426 12/1986 Wegener et al. .
4,639,954 2/1987 Speed .
4,686,719 8/1987 Johnson et al. .
4,691,397 9/1987 Netzer .
4,729,576 3/1988 Roach .
4,768,241 9/1988 Beney .
4,793,428 12/1988 Swersey .
4,795,122 1/1989 Petre .
4,821,348 4/1989 Pauna .
4,862,529 9/1989 Peck .
4,894,876 1/1990 Fenwick .
4,896,389 1/1990 Chamberland .
4,905,944 3/1990 Jost .
4,920,587 5/1990 Kerr .
4,944,292 7/1990 Gaeke .
4,945,592 8/1990 Sims .
4,949,413 8/1990 Goodwin .
4,953,243 9/1990 Birkmann .
4,953,247 9/1990 Hasty .
4,957,121 9/1990 Icenogle .
4,962,552 10/1990 Hasty .
4,966,340 10/1990 Hunter .
4,985,946 1/1991 Foster et al. .
4,987,620 1/1991 Sharon .
5,005,230 4/1991 Congdon .
5,022,105 6/1991 Catoe .
5,033,563 7/1991 Brainerd, Jr. et al. .
5,042,470 8/1991 Kanesaka .
5,044,029 9/1991 Vrzalik .
5,050,695 9/1991 Kleinwulterink .
5,054,141 10/1991 Foster et al. .
5,065,464 11/1991 Blanchard et al. .
5,067,189 11/1991 Weedling et al. .
5,072,906 12/1991 Foster .
5,077,843 1/1992 Foster et al. .
5,083,331 1/1992 Schnelle et al. .
5,083,625 1/1992 Bleicher .
5,090,077 2/1992 Caden et al. .
5,092,007 3/1992 Hasty .
5,103,518 4/1992 Gilroy et al. .
5,103,519 4/1992 Hasty .
5,109,560 5/1992 Uetake .
5,117,521 6/1992 Foster et al. ..... 5/503.1 X
5,117,819 6/1992 Servidio .
5,121,512 6/1992 Kaufmann .
5,134,737 8/1992 Wymar ..... 5/604 X
5,157,800 10/1992 Borders .
5,181,289 1/1993 Kassai .
5,193,633 3/1993 Ezenwa .
5,335,651 8/1991 Foster et al. ..... 5/503.1 X
5,337,845 8/1994 Foster et al. ..... 5/510 X
5,370,111 12/1994 Reeder et al. ..... 5/503.1 X

PRIOR ART CARE PATH

MODULAR HOSPITAL BED AND METHOD OF PATIENT HANDLING

RELATED APPLICATIONS

This application is a continuation-in-part of application Ser. No. 08/186,657, filed Jan. 25, 1994, as Express Mail No. FB436184716US, entitled FOOT EGRESS CHAIR BED, still pending, a continuation-in-part of application Ser. No. 08/221,748, filed Mar. 31, 1994, as Express Mail No. TB219496013US, entitled PATENT WEIGH SCALE, still pending, a continuation-in-part of application Ser. No. 08/221,633, filed Apr. 1, 1994, as Express Mail No. TB219496002US, entitled LOW AIR LOSS MATTRESS WITH RIGID INTERNAL BLADDER AND AIR PALLET, still pending, and a continuation-in-part of application Ser. No. 08/007,122, filed Jan. 21, 1993, entitled VENTILATOR, CARE CART AND MOTORIZED TRANSPORT EACH CAPABLE OF NESTING WITHIN AND DOCKING WITH A HOSPITAL BED BASE, now U.S. Pat. No. 5,337,845, which is a continuation-in-part of application Ser. No. 07/912,826, filed Jul. 13, 1992, entitled VENTILATOR AND CARE CART EACH CAPABLE OF NESTING WITHIN AND DOCKING WITH A HOSPITAL BED BASE, now U.S. Pat. No. 5,335,651, which is a continuation-in-part of application Ser. No. 07/874,586, filed Apr. 24, 1992, entitled MOBILE VENTILATOR CAPABLE OF NESTING WITHIN AND DOCKING WITH A HOSPITAL BED BASE, now U.S. Pat. No. 5,370,111, which is a continuation-in-part of application Ser. No. 07/524,038, filed May 16, 1990, now U.S. Pat. No. 5,117,521, entitled CARE CART AND TRANSPORT SYSTEM, all of which are hereby incorporated by reference herein as if fully set forth in their entirety.

FIELD OF THE INVENTION

This application relates generally to patient care and hospital beds, and more particularly to a method of patient care which reduces the number of surface-to-surface transfers a patient must undergo during a patient's stay in a hospital and to a modular hospital bed employed in the practice of that method.

BACKGROUND OF THE INVENTION

During a typical patient hospital stay, for example a cardiovascular patient's stay of seven days, that patient may be moved through as many as six different levels of care during that stay, while incurring as many as a dozen surface-to-surface transfers from one bed or stretcher to another as the patient is transferred to, treated in and transferred from a particular care area.

More specifically, the patient would be admitted into the emergency room, and upon being stabilized would then be transferred to the imaging/x-ray department. After having been x-rayed, the patient would then be transferred to the operating room for surgery, and after surgery would then be transferred to the post anesthesia care unit for recovery from anesthesia. From there the patient would be transferred to the surgical intensive care unit for intensive monitoring and care provider intervention should the need arise. Then the patient is transferred to a step-down unit as a transition from intensive care and prior to being transferred to the med/surg unit for routine monitoring. Once routine patient monitoring is completed in the med/surg unit, the patient is discharged from the hospital.

Currently, hospitals generally utilize a specific bed for each level of patient care or care area through which a patient travels along the care path during the entire hospital stay. This traditional patient handling system breaks up the care process into specialized activities requiring multiple beds. For example, a stretcher is employed upon admittance for transporting the patient quickly and conveniently to and between the emergency department, imaging/x-ray and the operating room. In the critical care unit, for example the post anesthesia care unit and surgical intensive care unit, an intensive care bed is utilized. Lastly, in the step-down unit and the med/surg unit, a med/surg bed is utilized. Thus multiple, specialized beds are required for patient care.

In addition, once the patient progresses to the therapy/rehabilitation phase of care, the patient must periodically leave his or her bed and be transported to a therapy area for exercising etc. Such a therapy area is typically outfitted with therapy equipment of various types and kinds which is either purchased or rented by the hospital. Thus currently provided care requires yet another patient transfer.

This traditional means of patient handling with specific beds suited to distinct care levels results in at least two disadvantages. The first disadvantage is the number of beds a hospital must purchase. This for the reason that at least three types of beds are required for each patient during their hospital stay. Assuming just a stretcher bed, intensive care bed and med/surg bed for each patient, and there could be more types of beds for a patient than just these three, a hospital is required to purchase three types of beds or patient supports for each patient the hospital will treat.

The second disadvantage with this traditional bed and patient handling scheme is that the patient must undergo and endure as many as a dozen surface-to-surface transfers from one specialized bed or stretcher to another as the patient moves through the various levels of care of the care path during a patient's hospital stay as well as room changes. Such surface-to-surface transfers and room changes not only require additional staff, labor and time, etc. but can negatively impact the total patient outcome.

SUMMARY OF THE INVENTION

It has therefore been an objective of the present invention to reduce the number of separate or different types of hospital beds which a hospital must purchase in order to treat a patient during that patient's hospital stay from admittance into the emergency room up to and through discharge from the hospital.

It has been another objective of the present invention to provide a method of patient handling which greatly reduces the number of patient bed surface-to-surface transfers and room changes and which provides a consequent improvement in patient outcome during the patient's hospital stay and which reduces the length of the patient's hospital stay.

In accordance with the stated objectives and toward those ends, the present invention provides a modular bed and method of patient handling which permits a patient to remain on a single hospital bed from admittance to and through discharge from a hospital, thereby reducing the number of patient bed surface-to-surface transfers the patient must endure with a consequent improvement in patient outcome, as well as reducing the number of different hospital beds required to treat a patient during the patient's hospital stay thereby reducing hospital capital expenditures. The modular bed is transformable so that it can meet the patient's needs during their entire care cycle from admittance to through discharge from the hospital. The modular bed and method support the patient and staff with the right features at the right time without the need for room or bed transfers, thus reducing surface-to-surface transfers, reducing the risk of patient or staff injury, and improving staff efficiencies. The method comprises the steps of providing a plurality of rollable modular beds, assigning a patient to one of the modular beds upon admittance to a hospital emergency room, providing a plurality of retrofittable modules for selective removable securement to the modular beds, with at least one module being provided from each of a patient transport module group, critical care module group and ambulatory/rehabilitation module group, and transforming the one modular bed as the patient is treated in and transferred from the emergency room and transferred to, treated in and transferred from the surgery room, the critical care unit and the med/surg unit and finally discharged, by securing to and removing from the one bed selected ones of the retrofittable modules thereby tailoring the one bed to the needs of the patient at any point from admittance to, through discharge from, the hospital.

The retrofittable modules when secured to the modular bed preferably reside substantially within a bed footprint defined by projecting the periphery of the bed downwardly onto a floor surface, so as to not negatively affect the movement of the bed during transport by a care provider.

The modular bed is preferably provided with a base having a stem and a pair of outspread arms on each end of the stem. The stem and pairs of arms define head and foot end cavities into which selected ones of the modules reside when secured to the modular bed.

The modular bed is preferably provided with a vacatable foot portion providing access to the foot end cavity by selected ones of the modules.

The modular bed is transformed into a patient transport type bed for use as a transport vehicle prior to surgery or during diagnostic testing by selecting a patient transport module with which to retrofit the modular bed from the group consisting of a rollable motorized transport module dockable to the head end of the bed to aid a care provider in moving the bed from place to place and a rollable care cart module dockable to the foot end of the bed providing life support to a patient on the bed during transport.

The modular bed is transformed into a critical care type bed by selecting a critical care module with which to retrofit the bed from the group consisting of a combination low air loss mattress with rigid internal bladder and air pallett module for preventing patient bedsores, weighing the patient and facilitating surface-to-surface transfers of the patient, a rollable patient scale module dockable to a side of the bed for weighing the patient, compression boots, hypothermia equipment, pulse-oxymetry equipment, vital signs monitoring equipment and a CPM device.

The modular bed is transformed into an ambulatory/rehabilitation type bed by selecting an ambulatory/rehabilitation module with which to retrofit the bed from the group consisting of a rollable exerciser module for docking to a foot end of the bed for rehabilitation, a combination rollable scooter and walker dockable to the foot end of the bed for providing an independent means of ambulation, a rollable toileting module dockable to a foot end of the bed, a wheelchair module dockable to a foot end of the bed and a wireless nurse call/patient follower module providing an ambulatory patient a means of locating a nurse as well as providing staff a means of locating a patient.

The head end cavity of the modular bed advantageously provides space for accommodating the removably securable motorized transport patient transport module which advantageously docks thereto to aid a care provider in moving a bed from place to place.

The foot end cavity of the modular bed advantageously provides space for receiving thereat the ambulatory/rehabilitation module which is selected from the group consisting of an exerciser module, walker module, toilet module and wheelchair module which are dockable thereto to aid a patient in ambulations and rehabilitation.

One advantage of the modular hospital bed and method of patient handling of the present invention is that the number of separate or different types of hospital beds which a hospital must purchase in order to treat a patient during a patient's stay is reduced.

Another advantage of the present invention is that the method of patient handling of the present invention greatly reduces the number of patient bed surface-to-surface transfers which a patient must endure and which improves the overall patient outcome during a patient's hospital stay.

These and other objects and advantages of the present invention will become more readily apparent during the following detailed description taken in conjunction with the drawings herein, in which:

DETAILED DESCRIPTION OF THE INVENTION

Figure 1:
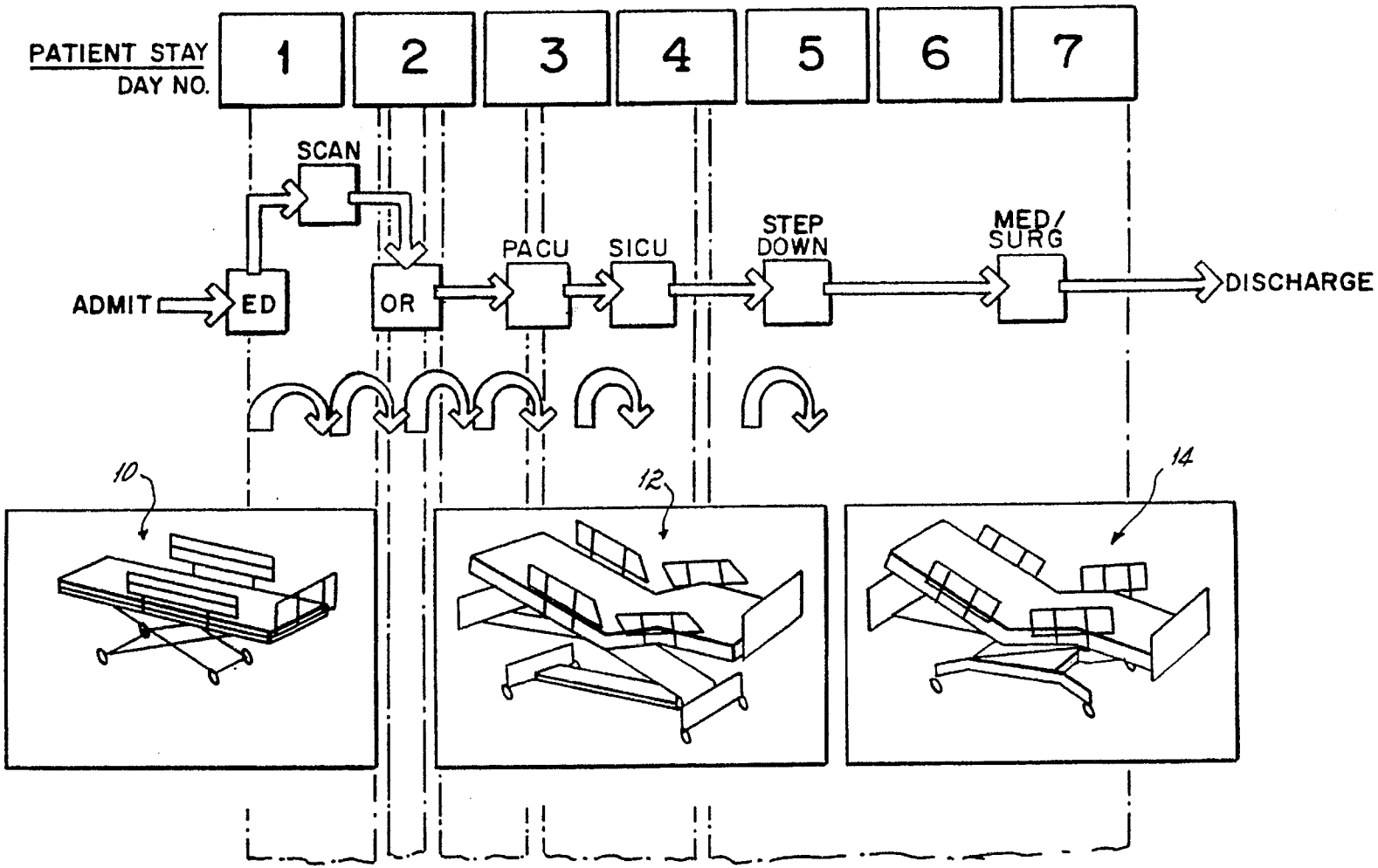
FIG. 1 illustrates the prior art care path which includes at least seven levels of care, three different types of hospital beds and numerous surface-to-surface transfers a patient must undergo during the care path.

With reference first to FIG. 1, there is illustrated the traditional care path of a patient, for example a cardiovascular patient, during a conventional seven-day hospital stay. As can be seen from the figure, at least three different types of hospital beds are employed by a hospital for treating that patient during the seven-day hospital stay: a stretcher bed 10, an intensive care bed 12 and a med/surg bed 14. The patient will encounter at least six levels of care during a traditional seven-day hospital stay. The patient will be admitted through the emergency room or department ED, and then upon being stabilized will be transferred to the imaging/x-ray department SCAN. After having been x-rayed, the patient would then be transferred to the operating room OR for surgery, and after surgery would then be transferred to the post-anesthesia care unit PACU for recovery from anesthesia. From PACU the patient would then be transferred to the surgical intensive care unit SICU for intensive monitoring and care provider intervention should the need arise. Then the patient is transferred to a step down unit STEP DOWN as a transition from intensive care and prior to being transferred to the med/surg unit MED/SURG for routine monitoring. From the med/surg unit MED/SURG the patient is discharged from the hospital.

As will be seen in FIG. 1, the prior art stretcher bed 10 is generally employed upon admittance for transporting the patient quickly and conveniently to and between the emergency department ED, imaging/x-ray SCAN and the operating room OR. In the critical care area or unit, which encompasses the post anesthesia care unit PACU and the surgical intensive care unit SICU, the intensive care bed 12 is utilized. Once a patient is transferred from the intensive care unit to the step down unit STEP DOWN, a med/surg bed 14 is utilized, through the patient's med/surg stay and up to discharge. Thus the patient must be transferred from one hospital bed surface to another hospital bed surface many times during the traditional seven-day patient stay, and often incurring as many as a dozen surface-to-surface transfers which can increase the risk of patient injury and decrease staff efficiency.

Figure 2:
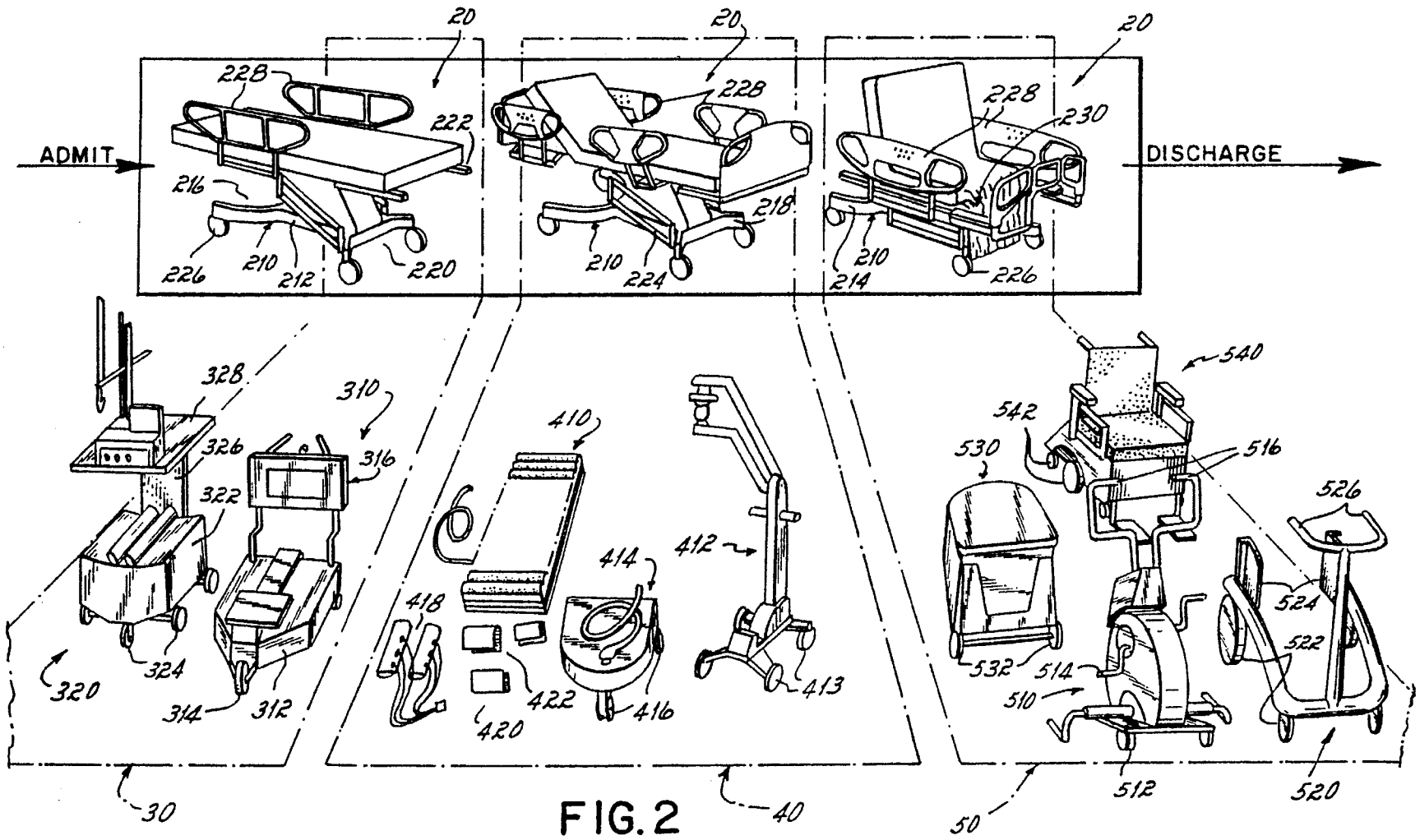
FIG. 2 illustrates the three types of beds into which the modular bed of the present invention is transformable and the associated retrofittable modules for each.
Figure 3:
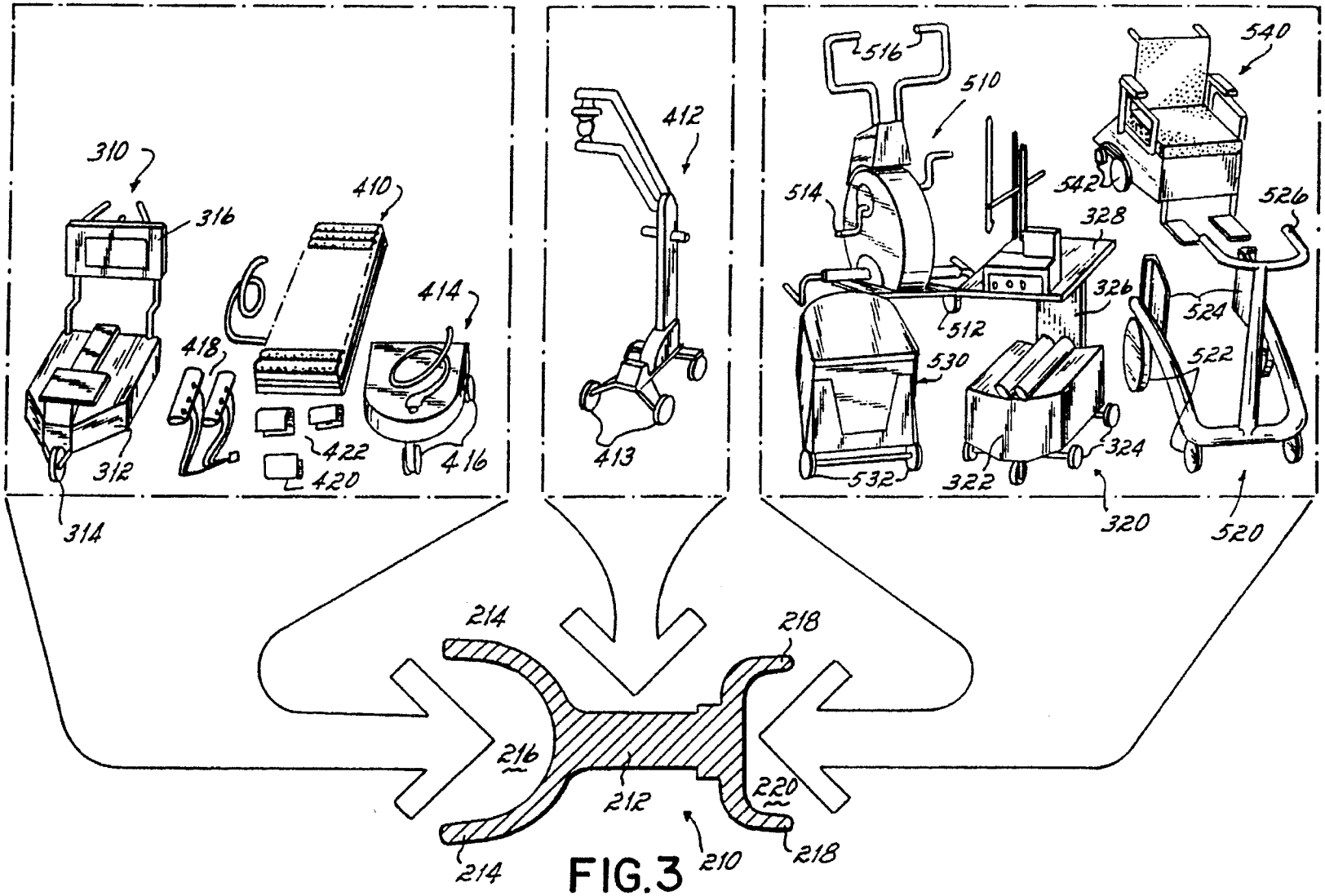
FIG. 3 illustrates the general location of the modular hospital bed into which each of the retrofittable modules would reside during attachment to the bed.
Figure 4:
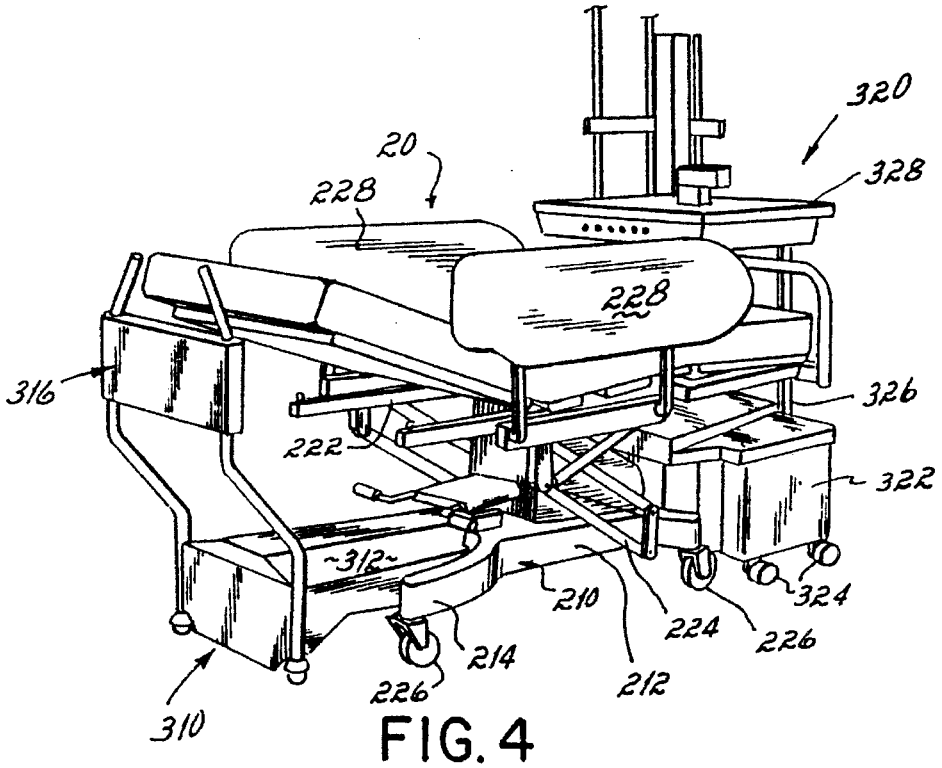
FIG. 4 illustrates the modular bed configured as a patient transport bed.
Figure 5:
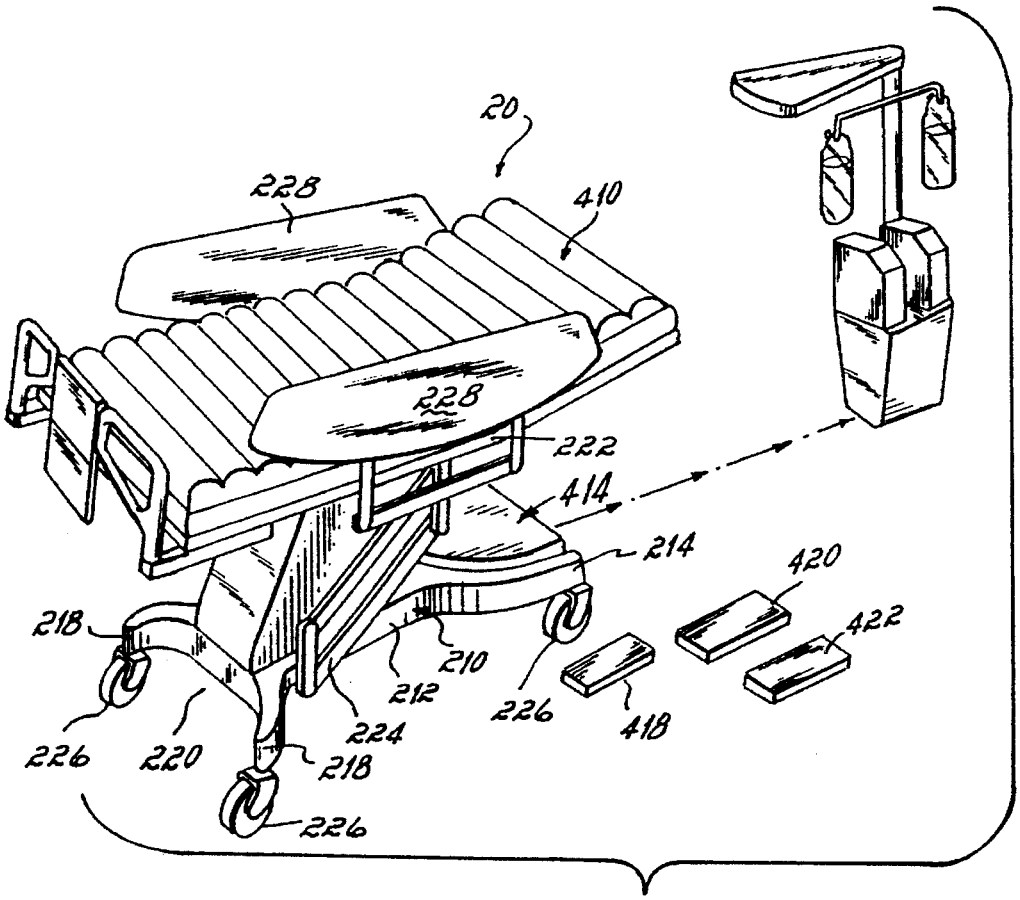
FIG. 5 illustrates the modular bed configured as a critical care bed.

Referring now to FIG. 2, a modular bed 20 according to the principles of the present invention is shown. The bed 20 includes a base 210 having a longitudinally oriented stem 212, a pair of diverging outspread arms 214, 214 on one end thereof forming a head cavity 216 therebetween, a pair of outspread diverging arms 218, 218 on the other end thereof forming a foot end cavity 220 therebetween, a patient support 222 and linkage 224 mounting the patient support 222 above the base 210. Casters 226 are mounted to the ends of the outspread arms 214, 214 and 218, 218 and patient guards 228 are mounted about the patient support 222. The modular bed 20 includes a vacatable foot portion 230, the need for which will be described subsequently. The bed 20 can be customized or tailored to meet the needs of the orthopedic patient, cardiac patient, neurological patient or general care patient.

The modular bed 20 is transformable to provide value throughout the patient's entire care cycle, with the goal to reduce the patient's length of hospital stay, through the use of retrofittable modules, thereby producing three types of beds from the one modular bed: a patient transport bed, a patient critical care/step down bed and finally a patient ambulatory/rehabilitation bed. The retrofittable modules for transforming the modular bed during these three phases of patient care are thus from three general groups: patient transport 30, patient critical care/step down 40 and patient ambulatory/rehabilitation 50.

The patient transport module group 30 includes a rollable motorized transport module 310 which is dockable at the head end 216 of the bed 20 to aid a care provider in moving the bed from place to place. The transport module 310 includes a base 312 with a motorized drive wheel 314 and upright steering structure 316 for steering the transport 310 and bed 20 and allows for easy and effortless transport of the patient and equipment. The transport module group 30 further includes a rollable care cart module 320 dockable to the foot end 220 of the bed 20 for providing life support to a patient on the bed 20 during transport of the patient about the hospital. The care cart module 320 includes a base 322 with rollers 324 and an upright support structure 326 with forwardly projected shelf 328. The cart module 320 may carry air, oxygen, a ventilator, vital signs monitoring equipment, and other critical care equipment and is thus used during the transport of the critically ill and allows for the handling of monitors and life supporting equipment without compromising the care of the patient, as well as reducing the number of personnel required during a transport. A preferred form of cart module 320 is disclosed in application Ser. No. 07/912,826, filed Jul. 13, 1992, entitled VENTILATOR AND CARE CART EACH CAPABLE OF NESTING WITHIN AND DOCKING WITH A HOSPITAL BED BASE assigned to the assigneee of the present invention. A preferred form of transport module 310 is disclosed in application Ser. No. 08/007,122, filed Jan. 21, 1993, entitled VENTILATOR, CARE CART AND MOTORIZED TRANSPORT EACH CAPABLE OF NESTING WITHIN AND DOCKING WITH A HOSPITAL BED BASE, also assigned to the assignee of the present invention.

The bed 20 is preferably outfitted with a fifth wheel steering system, along with an adjustable bed width and inboardly tucking sideguards for greater mobility, improving access across the patient while providing a narrower dimension for going in and out of doorways, and for reducing the bed width, respectively. Preferred forms of these features are disclosed in applications Ser. No. 08/025,169, filed Mar. 2, 1993, entitled CARRIER WITH DEPLOYABLE CENTER WHEELS, Ser. No. 08/074,925, filed Jun. 10, 1993, entitled HOSPITAL BED WITH COLLAPSING WING, and Ser. No. 08/076,254, filed Jun. 11, 1993, entitled HOSPITAL BED WITH INWARDLY PIVOTING SIDE GUARDS HAVING IMPROVED LATCHING MECHANISM, respectively, all assigned to the assignee of the present invention and all of which are hereby incorporated by reference herein as if fully set forth in their entirety.

The critical care/step down group of retrofittable modules 40 include a combination low air loss mattress with rigid internal bladder and air pallet module 410 for placement on the bed 20. The mattress module 410 includes a high air loss air transfer lower portion to aid the care provider in surface-to-surface transfer of a patient, a low air loss upper surface for ventilating the patient's skin to avoid the development of bedsores and the like, and a rigidly inflatable middle portion for use with a rolling weigh scale module 412 which rolls by virtue of rollers 413 and which docks to one side of the bed base 210 for weighing a patient. The refittable module group 40 further includes an air handling unit module 414 which includes rollers 416 and which docks within the head end cavity 216 of the bed 20. Other modules which can be included in the critical care/step down group 40 are compression boots, hypothermia equipment, pulse-oxymetry equipment, vital signs monitoring equipment, and a CPM device, some of which are shown schematically at 418, 420 and 422 which allow the componentry to be integral to the bed frame and provide easy access for the staff. Thus these accessories are designed to be integrated directly into the bed and located off of the floor which will reduce floor clutter, keeping the floor clear. A preferred form of the weigh scale module 412 is disclosed in application Ser. No. 08/221,748, filed Mar. 31, 1994, as Express Mail No. TB219496013US, entitled PATIENT WEIGH SCALE assigned to the assignee of the present invention. A preferred form of the mattress module 410 is disclosed in application Ser. No. 08/221,633, filed Apr. 1, 1994, as Express Mail No. TB219496002US, entitled LOW AIR LOSS MATTRESS WITH RIGID INTERNAL BLADDER AND AIR PALLET, also assigned to the assignee of the present invention.

The ambulatory/rehabilitation group of retrofittable modules 50 includes a number of modules each of which dock to the foot end cavity 220 by virtue of the vacatable portion 230 of the foot end of the bed 20 providing access thereto. Rather than purchasing or renting special therapy beds as is the current practice, the ambulatory/rehabilitation group of retrofittable modules 50 transform the modular bed 20 into special therapy beds. The modules can be placed on the modular bed 20 and used throughout the hospital at any point during the patient's stay. The advantages of the modular bed 20 and modules 50 include reduction in numbers of current specialty rental devices, better control of usage of these devices, improved response time for usage and the efficiencies of a modular bed.

Figure 6A:
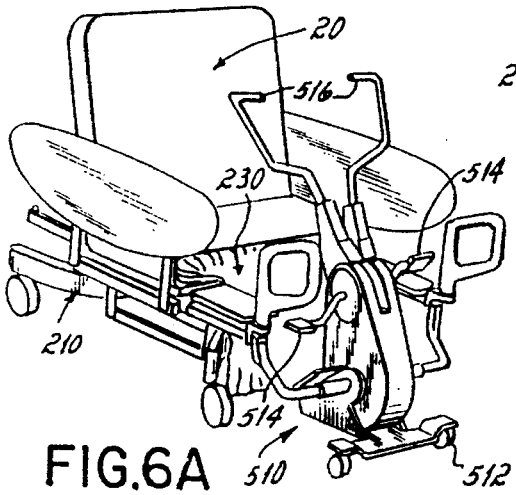
FIGS. 6A–E illustrate the bed configured as an ambulatory/rehabilitation bed.
Figure 6B:
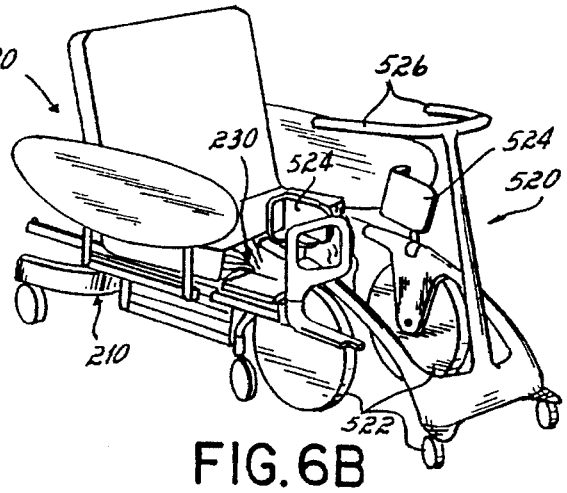
Figure 6C:
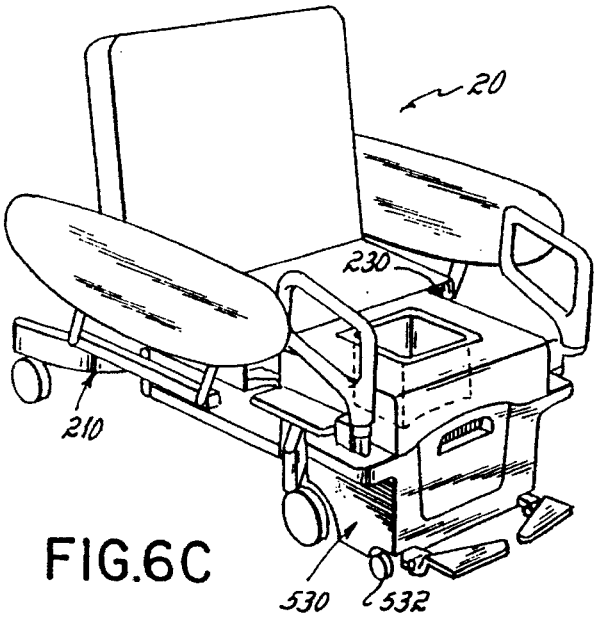
Figure 6E:
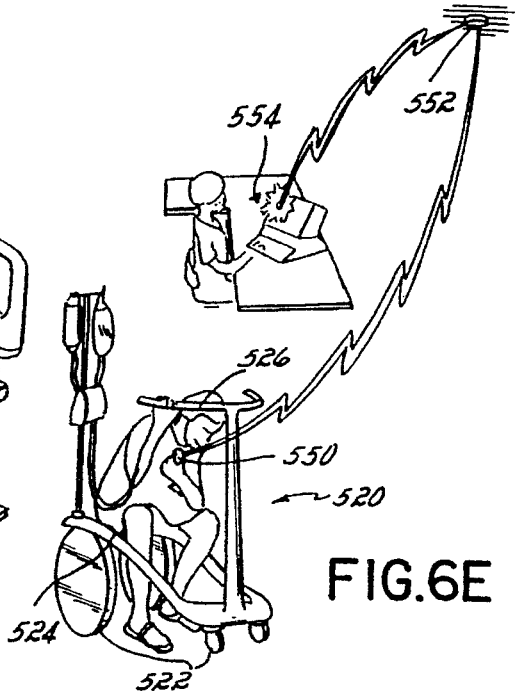
Figure 6D:
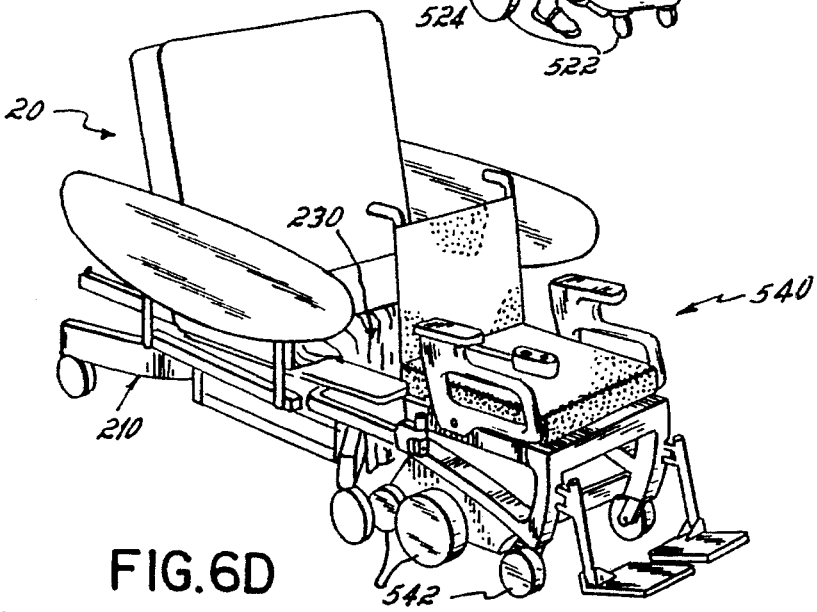

Such modules include an exerciser module 510 which includes rollers 512 for rolling movement, pedals 514 for exercising the legs of a patient, and movable handles 516 for exercising the upper body of a patient. A combination scooter and walker module 520 is provided which has rollers 522, a seat 524 which pivots upwardly for use as a walker and which pivots downwardly for use as a scooter, and handles 526 for grasping by a patient. A toilet module 530 also includes rollers 532 for rolling movement for use with the bed during the ambulatory/rehabilitation phase of care for the bedridden or long-term type patient thereby obviating the need of a patient to leave the bed to go to a bathroom. A wheelchair module 540 also rollable via rollers 542 is provided for docking with the bed 20 for patient ambulations and may form a part of the bed 20 itself. Lastly, a wireless nurse/patient follower module 550 (FIG. 6E) could be worn by the patient during this ambulatory/rehabilitation phase which would transmit signals via a relay 552 to a nurse station 554 for providing an ambulatory patient with a means for locating a nurse as well as providing staff a means of locating a patient. The ambulatory/rehabilitation module group 50 could further include an incontinence management module that pulls moisture away from the patient, a full body bathing surface module and a rotational therapy patient support module for retrofitting onto bed 20. Further, the bed 20 with vacatable foot portion 230 provides for convenient patient egress from the foot end of the bed 20 when portion 230 is vacated. A preferred form of bed 20 with vacatable foot portion 230 is disclosed in application Ser. No. 08/186, 657, filed Jan. 25, 1994, as Express Mail No. FB436184716US, entitled FOOT EGRESS CHAIR BED, assigned to the assignee of the present invention.

In use, modular bed 20 is first configured as a patient transport type bed for use in transporting a patient from admittance to the emergency department ED, to imaging/x-ray SCAN and then to the operating room OR. The bed 20 is thusly configured by selecting the motorized transport 310 and care cart 320 modules from the patient transport group 30 and removably securing these to the bed 20 at the head end cavity 214 and foot end cavity 220.

When the patient enters the critical care area PACU and SICU, the patient transport modules 310 and 320 are then removed from the bed 20 and critical care/step down modules are selected from the critical care/step down module group 40 for removable securement to the bed 20. Thus modules such as the combination low air loss treatment and high air loss transfer pad module 410 are placed on the bed 20, and the rolling air handler module 414 is docked to the bed 20 at the head end cavity 214 for supporting the mattress module 410, as are other patient critical care modules such as compression boots, hypothermia equipment, pulse-oximetry equipment, vital signs monitoring equipment and a CPM device 418, 420 and 422. The rollable scales module 412 is docked to the bed at a side thereof during this portion of patient care as needed for weighing the patient.

As the patient moves to the med/surg area MED/SURG, the bed 20 is then configured as an ambulatory/rehabilitation bed. The critical care/step down modules are removed from the bed 20 and ambulatory/rehabilitation modules are selected from the ambulatory/rehabilitation module group 50 for removable securement to the bed 20. Various ones of these modules are selectively docked to the bed 20 for various patient ambulation/rehabilitation therapy. For example, the exerciser device module 510 can be docked to the bed 20 for exercising of the patient. The walker/scooter module 520 can be docked to the bed 20 for aiding patient ambulations. The toileting module 530 can be docked to the bed 20 thus eliminating the need for the patient to leave the bed 20 to travel to the bathroom. The wheelchair module 540 can also be docked to the bed 20 and utilized for transporting a patient from place to place.

Upon patient discharge, the ambulatory/rehabilitation modules are then removed from the bed 20 and the bed is reconfigured into a patient transport bed as described above and is thus ready to be assigned to another patient admitted through the emergency department ED.

Those skilled in the art will readily recognize numerous adaptations and modifications which can be made to the modular hospital bed and method of patient handling of the present invention which will result in an improved bed and method, yet all of which will fall within the spirit and scope of the present invention as defined in the following claims. Accordingly, the invention is to be limited by the claims and their equivalents.

What is claimed is:

1. A method of patient handling which permits a patent to remain on a single hospital bed from admittance to, and through discharge from, a hospital, thereby reducing the number of bed surface-to-surface transfers the patient must endure and reducing the number of different hospital beds required to treat a patient, comprising the steps of:

providing a plurality of rollable modular beds;

assigning a patient to one of the modular beds upon admittance to a hospital emergency room;

providing a plurality of retrofittable modules for selective removable securement to the modular beds, with at least one module being provided from each of a patient transport module group, critical care module group and ambulatory/rehabilitation module group; and transforming the one modular bed as the patient is treated in and transferred from the emergency room and transferred to, treated in and transferred from the surgery room, the critical care unit and the med/surg unit and finally discharged, by securing to and removing from the one bed selected ones of the retrofittable modules thereby tailoring the one bed to the needs of the patient at any point from admittance to, through discharge from, the hospital.

2. The method of claim 1 wherein the retrofittable modules when secured to the modular bed reside substantially within a bed footprint defined by projecting the periphery of the bed downwardly onto a floor surface.

3. The method of claim 1 wherein the modular bed is provided with a base having a stem and a pair of outspread arms on each end of the stem, the stem and pairs of arms defining head and foot end cavities into which selected ones of the modules reside when secured to the modular bed.

4. The method of claim 3 wherein the modular bed is further provided with a vacatable foot portion providing access to the foot end cavity by selected ones of the modules.

5. The method of claim 1 wherein the patient transport module group consists of:

a rollable motorized transport module dockable to a head end of the bed to aid a care provider in moving the bed from place to place, and a rollable care cart module dockable to a foot end of the bed providing life support to a patient on the bed during transport.

6. The method of claim 1 wherein the patient critical care module group consists of:

a combination low air loss mattress with rigid internal bladder and air pallet module;

a rollable patient scale module dockable to a side of the bed;

compression boots;

hypothermia equipment;

pulse-oximetry equipment;

vital signs monitoring equipment; and a CPM device.

7. The method of claim 1 wherein the ambulatory/rehabilitation module group consists of:

a rollable exerciser module dockable to a foot end of the bed for rehabilitation;

a combination rollable scooter and walker module dockable to the foot end of the bed for providing an independent means of ambulation;

a rollable toileting module dockable to the foot end of the bed;

a wheelchair module dockable to the foot end of the bed; and a wireless nurse call/patient follower module providing an ambulatory patient a means of locating a nurse as well as providing staff a means of locating the patient.

8. The method of claim 3 wherein the head end cavity is provided with a rollable motorized transport module dockable thereto to aid a care provider in moving the bed from place to place.

9. The method of claim 3 wherein the foot end cavity is provided with a rollable care cart module dockable thereto providing life support to a patient on the bed during transport.

10. The method of claim 4 wherein the foot end cavity and vacated foot portion is provided with a rollable ambulatory/rehabilitation module selected from the group consisting of an exerciser module, a walker module, a toilet module and a wheelchair module dockable thereto to aid a patient in ambulations and rehabilitation.

* * * * *